United States Patent [19]

Lagori et al.

[11] Patent Number: 4,945,736

[45] Date of Patent: Aug. 7, 1990

[54] DEVICE FOR STRETCHING HIDES, PARTICULARLY FOR MANUFACTURING FURS AND LIKE

[76] Inventors: Agostino Lagori, Via Morone 3, 20121 Milan; Giacomo Cotti, Via Stoppani 9, 20129 Milan, both of Italy

[21] Appl. No.: 132,977

[22] Filed: Dec. 15, 1987

[30] Foreign Application Priority Data

Dec. 31, 1986 [IT] Italy ..... 22902 A/86

[51] Int. Cl.[5] ..... C14B 1/26

[52] U.S. Cl. ..... 69/19.2; 69/19.3

[58] Field of Search ..... 69/19, 19.1, 19.2, 19.3

[56] References Cited

U.S. PATENT DOCUMENTS 1,489,654 4/1924 Beetz ..... 69/19.2

1,934,027 11/1933 Argabrite ..... 69/19.3

FOREIGN PATENT DOCUMENTS 117558 1/1947 Sweden ..... 69/19.2

*Primary Examiner*—Wm. Carter Reynolds

*Attorney, Agent, or Firm*—Kirschstein, Ottinger, Israel & Schiffmiller

[57] ABSTRACT

A device for stretching hides, particularly for manufacturing furs, wherein two hides are sewn along their longitudinal edges to form a hide muff which is then put, hair inside, on a drawing frame consisting of a middle strip and two side strips having outer sides symmetrically tapered and movable, limitedly as to the middle strip, in end sections. The strips show, at their ends, perforated seats for coupling with pins provided in a stretching frame more precisely by disposing the middle strip on positioning pins and the side strips on stretching pins existing in slides connected to a cylinder—piston assembly, for straddling purposes. Before the drawing, the hides, at their middle ends, are fastened by metal stitches at one end firstly, i.e. the tail side, and at the other end thereafter, head side, with previous light manual longitudinal stretch.

14 Claims, 3 Drawing Sheets

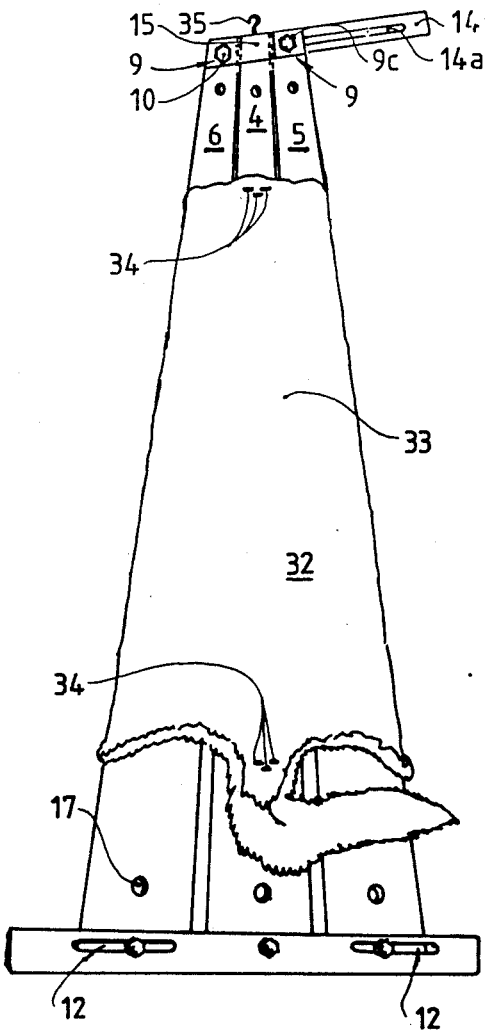
FIG. 9
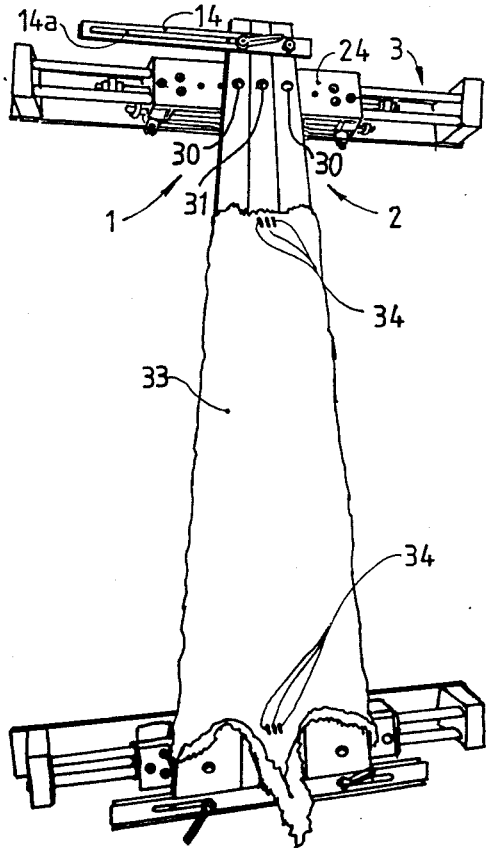
FIG. 6
FIG. 7
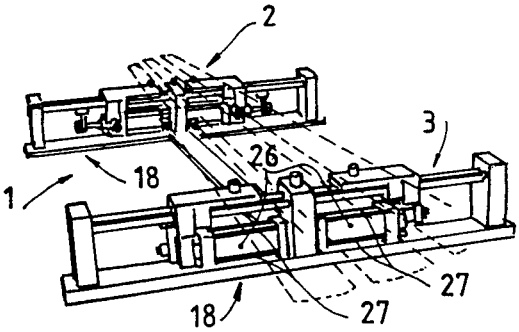
FIG.10
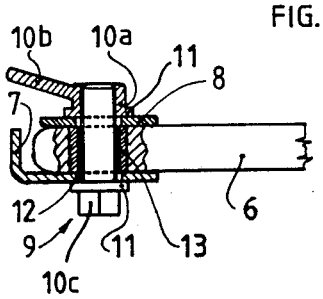

DEVICE FOR STRETCHING HIDES, PARTICULARLY FOR MANUFACTURING FURS AND LIKE

BACKGROUND OF THE INVENTION

The present invention concerns a device for stretching muff-sewn hides, particularly for manufacturing furs and the like.

For stretching, or drawing, hides for furs a method is presently known wherein the longitudinal edges of two overlapped hides are sewn and the resulting hide muff is then put on a substantially V-shaped frame having two strips with ends connected to leverages capable to be straddled by means of a threaded, hand driven rod. This frame presents various drawbacks and disadvantages, the most remarkable ones being the impossibility to stretch the hides in the middle of their ends, i.e. head side and tail side, as well as the need to stretch one end of said frame firstly and then the other end, re-establishing thereafter several times the stretching rate, in one end firstly and then in the other one, in consequence of the high deformation characteristics of the hide. The above method takes consequently a long time and in addition requires a stretching operation to be carried out by hand. Another disadvantage consists in that each frame is to be provided with two stretching mechanisms, which, besides affecting largely the total production costs, can be operated only by hand in the straddling and contraction steps, to be carried out, for each mechanism, successively and not simultaneously. From Italian Patent No. 1,185,292 issued Nov. 4, 1987 of the same applicants, a process and a device are known for stretching individual hides. The device comprises substantially a drawing frame having three strips fitted in end channels, the two outer strips being movable as to the middle strip.

A stretching frame is also provided substantially with two heads with two oppositely movable slides, respectively. The hide to be stretched is fastened, by metal stitches, along its longitudinal edges on the side strips and in the middle of the ends on the middle strip. For stretching the hide, the drawing frame is arranged in the stretching frame, the pins of side strips being fitted in seats provided in the mentioned slides and the pins of the middle strip fitted in seats existing in the fixed parts of the heads of the stretching frame. The separating movement of the side strips is effected by means of a cylinder-piston assembly connected to the slides, whereby the hide is stretched. Although said method and device provided a flawless stretching of the hide, which can be carried out quickly and with the desired stretching rate depending on the type of the hide to be stretched, it has been found that said method and device can be further improved.

SUMMARY OF THE INVENTION

The object of the present invention is to provide a process and a device which allow stretching the hides quickly and substantially uniformly in their entire surface, the process requiring individual steps to be carried out easily and quickly, wherein the device comprises a stretching frame easily assembled from a limited number of components and a drawing frame, also easily assembled from a limited number of components, whose handling is simple and feasible even by non-skilled workers. It falls within the scope of the stated object also the simplification of the coupling step between drawing frame and the stretching frame, preferably by visual observation of the effected coupling between the strips of the drawing frame and the corresponding coupling means of the stretching frame.

The process according to the invention is characterized in that it comprises the combination of the following peculiar steps, which are inpart individually known:

i. sewing two hides along their longitudinal edges to form a hide muff, ii. putting said hide muff, hair inside, on a drawing frame having three contiguous and coplanar strips, with the two outer strips symmetrically and longitudinally tapered, the ends of said strips being hinged on end sections with a limited displacement possiblility each end showing a seat for receiving a straddling pin, or alternatively a positioning pin, iii. after having longitudinally positioned the hide on said drawing frame, fastening by means of metal stitches each hide on the middle strip at one end, i.e. tail side, firstly and then at the opposite end, i.e. head side, with previous light manual longitudinal stretch of the hide, iv. after having arranged the drawing frame on a stretching frame, straddling the side strips of said drawing frame, whereby the hide muff is stretched on the same, v. fixing the side strips of the drawing frame in the end sections of the same, and vi. after having dried the hide muff and released the side strips of the drawing frame, removing the thread from the side seams of hide muff and the metal stitches from the middle strip for separating the two hides.

According to the invention the stretching device of a sewn hide muff is characterized in that it comprises:

i. a drawing frame for fitting a hide muff consisting of a middle strip and two side stips symmetrically tapered, the strips being hinged at their respective ends on a rapidly closing member of common end sections, the side strips being movably supported in oblong seats of said end sections and the middle and side strips having, at their ends, perforated seats for receiving a positioning pin and the stretching pin, respectively, and ii. a stretching frame with two stretching heads having two opposite slides connected to respective cylinder-piston assemblies and a pneumatic circuit with valves for controlling and inverting the movements of said slides, wherein each head consists of a base with two end uprights and one middle upright supporting, on the upper part, two parallel guide bars for the movement of the two slides, the respective cylinder-piston assemblies being fastened, in the lower part, to the middle upright and to the base, and wherein each slide presents further a large bearing area and a stretching pin for the coupling seat of the side strips of the drawing frame, said middle upright in its turn having a bearing area and a positioning pin for the coupling seat of the middle strip of the drawing frame.

Various advantages are obtained with the process and the device for stretching hides according to the invention. Firstly two hides all at once are stretched, whereas the two lateral seams and the fastening with metal stitches of the end middle areas of two hides take substantially a time of the same order of magnitude as the fastening with metal stitches of one hide on the three strips frame with outer parallel sides according to the aforementioned Italian Patent, whereby the stretching times for each hide are dramatically reduced. The fixing of two hides by sewing allows the hides to be correctly joined even with irregularly-shaped longitudinal sides, as usual, which permits the complete utilization of the hide such as delivered by the tannery, i.e; without pervious trimming of its longitudinal sides and consequently wastes, and, at the same time, the tubular form of two sewn hides permits a flawless and uniform stretching of both hides, apart from their individual form and size, because said tubular element can freely slide during the stretching step on the outer, rounded sides of the drawing frame.

The use of perforated coupling seats in the strips of the drawing frame allows the effected coupling between said strips and the positioning and stretching pins of the stretching frame to be quickly observed, whereby the straddling members can be afterwards operated quickly and reliably and especially with a maximum safety for the operator. The use of wide bearing areas, either on the slides or on the middle uprights of the stretching frame, also contributes in acheiving this result, whereby the three strips of the drawing frame are supported coplanarly and positioned automatically. These characteristics are maintained even apart from possible backlashes formed between the perforated coupling seats of the strips of the drawing frame and the pins of the stretching frame.

The proposed process allows hide wastes to be avoided and, consequently, an optimum utilization of hides to be obtained. The proposed device is structrually simple and compact and can be reliably operated.

BRIEF DESCRIPTION OF THE DRAWINGS

Other characteristics, advantages and details of the process and device according to the invention will appear from the following description with reference to the annexed drawings, illustrative of a preferred embodiment of the stretching device of hide according to the invention. In the drawings:

FIG. 6 is a schematic view of a drawing frame, with a hide muff inserted, arranged on the stretching device according to the invention, more precisely before the stretching step;

FIG. 7 is a schematic view showing the drawing frame on the stretching device, more precisely after the stretching step;

FIG. 9 is a schematic view of a drawing frame after the stretching step;

FIG. 10 is a sectional detail taken through the line X—X of FIG. 3;

DETAILED DESCRIPTION OF THE PREFERRED EMBODIMENT

Figure 1:
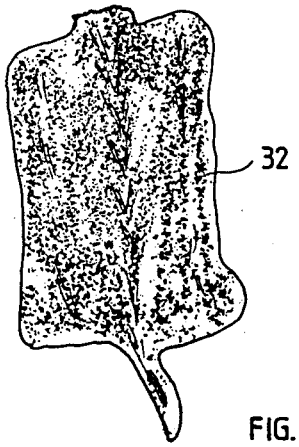
FIG. 1 is a schematic top view of a tanned hide for furs.
Figure 2:
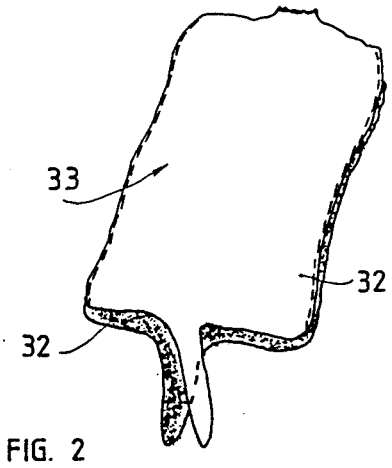
FIG. 2 is a perpective schematic view of a muff obtained by sewing two hides along their longitudinal edges.
Figure 4:
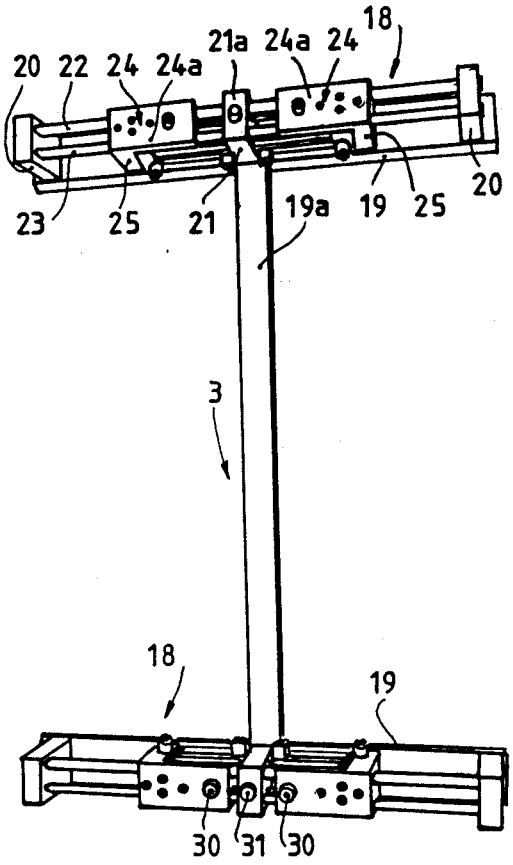
FIG. 4 is a schematic top view of the stretching device, without its pneumatic control circuit for sake of simplicity.
Figure 3:
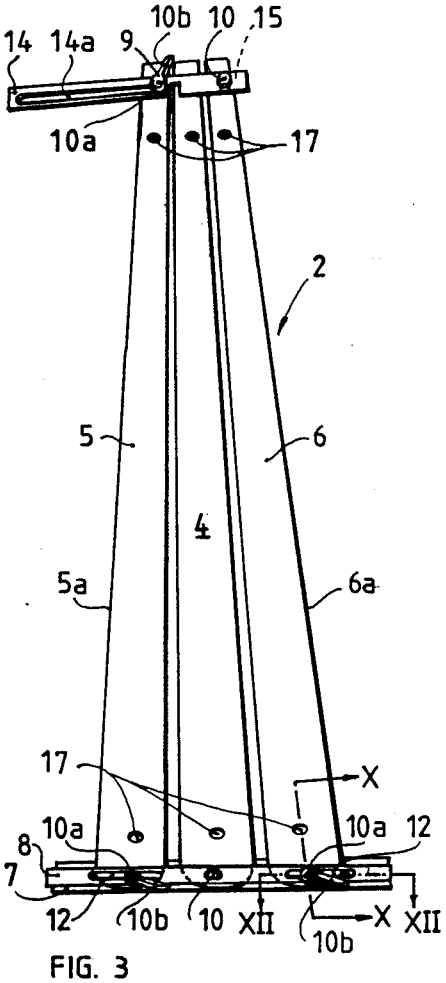
FIG. 3 is a schematic view of a drawing frame, with the strips closed, i.e. near to one another.

With reference to the above Figures, wherein like parts are indicated by like reference numbers and in different scales for the sake of clarity, the whole stretching device is indicated in 1. The same consists of a drawing frame 2 and a stretching frame 3. For a stretching frame 3 a plurality of drawing frames 2 is normally provided. The latter consists of three planar strips, in particular one middle strip 4 and two side stips 5, 6, all in a common plane. As clearly shown in the drawing, the side strips 5, 6 show outer sides 5*a*, 6*a*, symmetrically tapered and round—finished, as shown particularly in FIG. 10. The end of strips 4, 5 and 6 are connected to head and tail end sections, more exactly according to the following way. The wide ends of strips 4, 5 and 6 are connected to angle 7 and upper strip section 8 together serving as a tail end support, by means of a bolt 9 with nut member 10 for the middle strip 4, or alternatively nut 10*a* with handle 10*b* for the side strips 5 and 6. As shown particularly in FIG. 10, either the head 10*c* or the nuts 10, 10*a* show a washer base 11 having outer diameter larger than the width of oblong or transversely elongated holes or slide guiding slots 12, provided in the above-mentioned angle 7 and strip section 8. The bolts 9 pass through end holes 13 provided in strips 4, 5 and 6. The latter at their head or narrower ends are connected to two strip sections 14 and 15 together serving as a head end support. In particular, strip 6 is firmly clamped between sections 14 and 15 by means of bolt 9 with nut 10, the middle strip 4 is simply positioned, without bolts, between strip sections 14 and 15, and strip 5 is fastened on strip section 14 by a bolt 9 and nut 10*a* with handle 10*b*, said bolt 9 passing through transversely elongated slot 14*a* provided in strip section 14. The simplified form of end sections is advantageous for a convenient handling of the drawing frame and for an easier construction thereof, as explained in the following.

In 17 are indicated perforated seats, provided in end areas of strips 4, 5 and 6, the seats of strip 4 being positioning seats and the seats of strips 5 and 6 being stretching seats, as referred to in the following.

The stretching frame 3 comprises substantially two like-structured head and tail stretching stations 18 and therefore in the following description reference will be made only to one of them.

Figure 5:
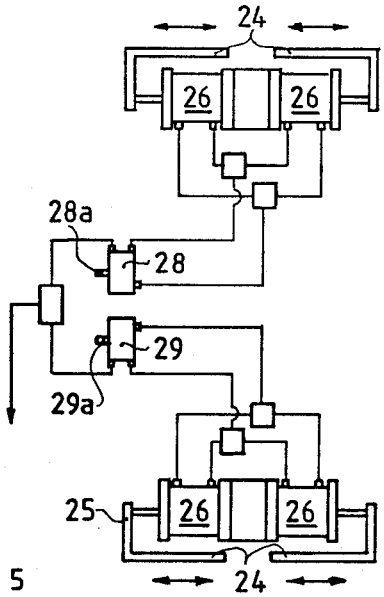
FIG. 5 is the basic scheme of the pneumatic circuit of the stretching device of FIG. 4.
Figure 8:
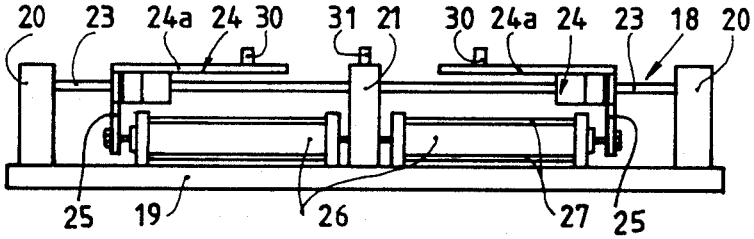
FIG. 8 is a schematic view of the stretching device.

Each stations shows a base 19 with two end uprights 20 and one central upright 21. The two stations are connected, in this example, by a connecting cross member 19*a*. In 22 and 23 are indicated two guiding bars transversely extending tracks or accommodated on the upper part of uprights 20 and 21. Between end uprights 20 and central upright member 21, a respective slide 24 is supported on the guiding bars 22 and 23, this slide 24 showing a folding 25 where the end of the piston rod of an operatively cylinder-piston assembly 26 is fastened. This latter is disposed on the base 19 beneath the slide 24. Advantageously the two cylinder-piston assemblies 26 one being a head drive means, the other being a tail drive means, for each station 18 are oppositely disposed and fastened on the base and on the middle upright 21 by means of their passing-through tension rods 27. Said cylinder-piston assemblies 26 are preferably of double-acting type and their control circuit is illustrated, by way of exemplification, in FIG. 5. In 28 and 29 are indicated the respective valves for controlling displacement and inversion of the assemblies 26 of the two heads. For sake of completeness, one must specify that, by moving levers 28*a* and 29*a* of valves 28, 29 in one direction, the displacement of the connection slides is caused in that direction and, by moving said levers 28*a* and 29*a* in the other direction, the inversion movement of said slides is caused, the closing position corresponding to the levers 28*a* and 29*a* being in the center. As shown in the drawing, the upper sides of slides 24 are provided, according to the invention, with a wide bearing area, transversally extending and indicated in 24*a*, the middle uprights 21 being also provided with a specific bearing area 21*a*. Slides 24 are futher provided with a stretching pin 30, the middle uprights 21 with a positioning pin 31.

Figure 11:
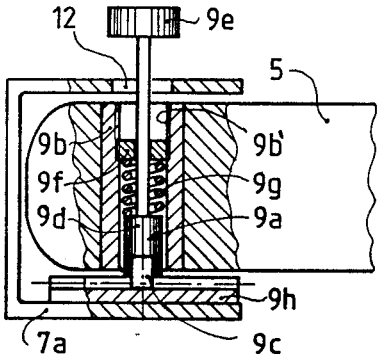
FIG. 11 is a sectional detail, analogous to FIG. 10, of a variant of the rapidly closing and opening means.
Figure 12:
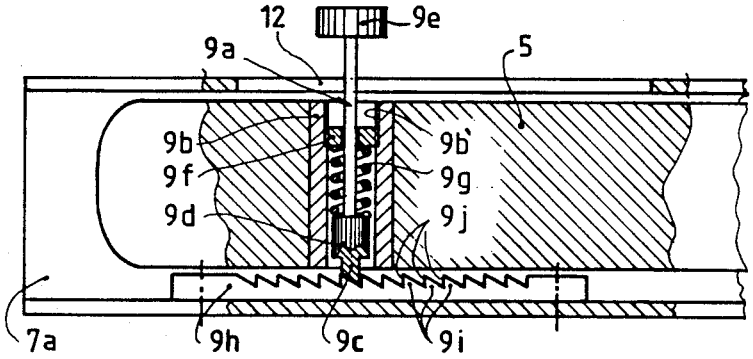
FIG. 12 is a sectional detail of the variant of FIG. 11 taken through the line XII—XII of FIG. 3.

The drawing process is carried out as follows:

after the sewing of the two hides 32 along their longitudinal edges to form a hide muff 33, this muff is put, hair inside, on a drawing frame 2, its strips being near to one another, disposed at about the middle of this muff. The middle of the tail side is then preliminarily fastened by metal stitches 34 on the middle strip 4 and, with previous light stretch, the middle of the head side is afterwards fastened by metal stitches 34 on the same middle strip 4. This operation is carried out for both hides and then the drawing frame 2 is arranged, strips 4, 5 and 6 being near to one another, on the stretching frame 3, wherein slides 24 too are near to one another. The arrangement is extremely easy, because one has only to introduce the perforated seats 17 of strips 4, 5 and 6 in pins 30 and 31 of heads 18. After coupling, which advantageously can be visually controlled, strips 4, 5 and 6 are firmly lying on slides 24 and middle uprights 21 of heads 18, whereby the drawing of the real stretching steps can be executed by operating valves 28 and 29 for the mutual separation of slides 24 in each head 18. After said displacement, the measure of which can be optionally selected depending on the desired hide stretching rate, the strips 4, 5 and 6 are mutually spaced. The bolts with nut 10*a* and handle 10*b*, its number being reduced to only three, are therefore tightened. On the narrow end side of the drawing frame 2 only one rapidly closing bolt 9, is in fact enough, as shown. Likewise, for the middle strip 4 a slide guiding seat provided by the two strip section 14 and 15 is sufficient. In strips 5 and 6, as alternative to bolts 9, spring pivot-shaped pawls 9*a* (FIGS. 11 and 12), fitted in bushes 9*b* supported in said strips 5 and 6, can be provided. Each pawl 9*a* shows a tooth 9*c*, a piston-like expansion 9*d* and a handle 9*e*. Between expansion 9*d* and a threaded ring 9*f*, an expansion spring 9*g* is disposed, screwed in the threaded 9*b'* of bush 9*b*. In 9*h* is indicated a rack section fastened to the end channel 7*a* having teeth 9*i* on the vertical pendent side 9*j*. In the expansion movement tooth 9*c* slides on teeth 9*i* and, at the end of the expansion displacement, enters tha last contiguous tooth 9*i* (FIG. 12).

After completion of the stretching steps, frames 2 with hides 32 being stretched are introduced in the drying oven, advantageously hung by hook 35. After drying, the rapidly operated bolts 9, will be released, whereby the side strips 5 and 6 will be easily displaced towards the middle in order to facilitate the removal of the side seam threads and of the metal stitches 34 thereafter. With pawls, the releasing operation will be carried out by simply lifting handle 9*e*. The thread removal is very easy with a chain-stitch seam, for example, and stitches 34 will be removed by simply acting on the same individual hide 32 for separating the same from strip 4. The drawing frame 2 is therefore ready to receive a second hide muff 33 and to be then arranged to the stretching frame 3.

From the description of the structure of the stretching device and of the operative steps for stretching hides, previously sewn to form a muff, accordingly to the invention it results that the device and process allow the basic object of the invention to be achieved and the advantages, mentioned in the preliminary part, to be obtained. Although the above description refers to a muff 33 formed by only two hides, sewn together, it is certainly possible according to the invention, particularly in case of smaller hides, to sew together even a higher number of hides to form a muff which can then be stretched according to the proposed process. Likewise, it results accordingly possible to stretch muffs, which form hide sectors, obtained from waste hide portions, or scraps, in order to utilize the same. The various part of the stretching device according to the invention can be obviously replaced by technical and/or functional equivalents, without departing from the protective field of the same. The rapidly fastenting bolt means, available with wide pitch threads, can also be replaced by other equivalent devices and the two cylinder-piston assemblies of each head can be replaced by a single assembly having two opposite pistons, and so on, without obviously departing from the protective field of the invention. Sizes and material can also be freely selected.

All characteristics resulting from the above description, as well as from the claims and drawings, are to be considered a substantial part of the present invention, eintherer individually or in any optional combination.

What is claimed is:

1. A device for stretching animal hides sewn together along longitudinal edges to form a tubular hide muff having a head end and an opposite tail end, comprising:

(A) at least one drawing frame including (a) an elongated middle strip and a pair of elongated side strips at opposite sides of the middle strip, said strips extending through the muff and past the head and tail ends thereof and terminating in head end regions at the head end of the muff and in tail end regions at the tail end of the muff, (b) a head end support extending transversely across the head end regions of the strips, (c) a tail end support extending transversely across the tail end regions of the strips, (d) means for pivotably mounting the tail and head end regions of the side strips to the tail and head end supports, respectively, (e) means for mounting at least one end region of the middle strip to at least one of the supports, and (f) means for detachably securing the tail and head ends of the muff to the tail and head end regions, respectively, of the middle strip;

(B) a stretching frame on which the drawing frame and the muff are mounted, said stretching frame having a head stretching station and a tail stretching station, each stretching station including (a) a transversely-extending track, (b) a central member stationarily mounted on the track at a central region thereof, (c) a pair of slide members at opposite sides of the central member and slidably mounted on and along the track, (d) means for detachably coupling the tail and head end regions of the middle strip to the stationary central member of each stretching station, and (e) means for detachably coupling the tail and head end regions of the side strips to the slide members of each stretching station;

(C) head drive means at the head stretching station for sliding the slide members thereat in opposite transverse directions away from each other, and for pivoting the side strips about their tail end regions, to a head stretching position in which the head end of the muff is stetched to a predetermined extent;

(D) tail drive means at the tail stretching station for sliding the slide members thereat in opposite transverse directions away from each other, and for pivoting the side strips about their head end regions, to a tail stretching position in which the tail end of the muff is stretched to a preselected extent; and (E) said head and tail drive means being independently operable to control the extent to which each of the tail end and the head end of the muff is stretched.

2. The device according to claim 1, wherein the strips are generally planar and lie in a common plane, each strip being tapered and converging in a direction from a respective tail end region to a respective head end region.

3. The device according to claim 2, wherein the side strips are symmetrically arranged relative to the middle strip, each side strip having an outer rounded longitudinal edge.

4. The device according to claim 1, wherein the tail end support has a pair of transversely-elongated slots, and wherein the pivotable mounting means includes a bolt at each tail end region of the side strips, each bolt having a shaft received in a respective slot and extending along a pivot axis, and a nut for engaging the bolt.

5. The device according to claim 4, wherein each nut has a handle turnable between a loosened state in which the bolt is free to move along a respective slot and in which the respective side strip is free to pivot about the pivot axis, and a locked state in which the bolt and the respective side strip are fixed in position relative to the tail end support.

6. The device according to claim 1, wherein the tail end support has a pair of transverse toothed racks, and wherein the pivotable mounting means includes a plunger at each tail end region of the side strips, a pawl on the plunger, and a spring for urging the pawl against the toothed rack.

7. The device according to claim 6, wherein the plunger includes a pull handle pullable between a locked state in which the pawl lockingly engages one of the teeth on the rack, and a released state in which the pawl is moved out of engagement with said one tooth.

8. The device according to claim 1, wherein the head end support has one transversely-elongated slot, and wherein the pivotable mounting means includes a bolt at the head end region of one of the side strips, said bolt having a shaft received in the slot and extending along a pivot axis, and a nut for engaging the bolt.

9. The device according to claim 8, wherein the nut has a handle turnable between a loosened state in which the bolt is free to move along the slot, and a locked state in which the bolt is fixed in position relative to the head end support.

10. The device according to claim 1, wherein each coupling means includes a hole at respective end regions of the middle and side strips, and a pin on respective central and slide members, each pin being received in a respective hole.

11. The device according to claim 1, wherein each drive means includes a hydraulic piston-cylinder unit mounted on the stretching frame at opposite sides of the central member, the piston of each unit being connected to a respective slide member.

12. The device according to claim 11, wherein each drive means includes a hydraulic valve and a manually-operable control lever, said valve being in hydraulic communication with a respective unit.

13. The device according to claim 12, wherein the control levers are independently movable.

14. The device according to claim 1, wherein the stretching means includes an elongated cross member for positioning the head and tail stretching stations apart.

* * * * *